US009557707B2

(12) United States Patent
Ueyama et al.

(10) Patent No.: US 9,557,707 B2
(45) Date of Patent: Jan. 31, 2017

(54) IMAGE FORMING APPARATUS

(71) Applicant: Brother Kogyo Kabushiki Kaisha, Nagoya-shi, Aichi-ken (JP)

(72) Inventors: Junki Ueyama, Nagoya (JP); Takehiro Masuda, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/814,624

(22) Filed: Jul. 31, 2015

(65) Prior Publication Data

US 2016/0187839 A1 Jun. 30, 2016

(30) Foreign Application Priority Data

Dec. 26, 2014 (JP) ..... 2014-264079
Dec. 26, 2014 (JP) ..... 2014-264082

(51) Int. Cl.

| | |
|---|---|
| ***G03G 15/00*** | (2006.01) |
| ***G03G 21/16*** | (2006.01) |
| *H01H 3/16* | (2006.01) |
| *H01H 13/18* | (2006.01) |

(52) U.S. Cl.

CPC ..... *G03G 21/1633* (2013.01); *G03G 15/55* (2013.01); *G03G 21/1619* (2013.01); *H01H 3/161* (2013.01); *H01H 13/186* (2013.01)

(58) Field of Classification Search

CPC ..... G03G 21/1633; G03G 21/1647; G03G 21/1842; G03G 2221/1654; G03G 15/55
USPC ..... 399/110
See application file for complete search history.

(56) References Cited

U.S. PATENT DOCUMENTS

| | | | | |
|---|---|---|---|---|
| 2007/0098437 | A1 | 5/2007 | Kaiga | |
| 2011/0182614 | A1* | 7/2011 | Onuma | G03G 21/1633 399/110 |
| 2011/0285075 | A1* | 11/2011 | Nakamura | B65H 1/266 271/109 |
| 2013/0287434 | A1* | 10/2013 | Hisano | G03G 21/1633 399/110 |

FOREIGN PATENT DOCUMENTS

| | | | |
|---|---|---|---|
| JP | H10254328 | A | 9/1998 |
| JP | 2002067437 | A | 3/2002 |
| JP | 2007121746 | A | 5/2007 |
| JP | 2007168405 | A | 7/2007 |
| JP | 2013242535 | A | 12/2013 |

* cited by examiner

*Primary Examiner* — Walter L Lindsay, Jr.
*Assistant Examiner* — Jessica L Eley
(74) *Attorney, Agent, or Firm* — Banner & Witcoff, Ltd.

(57) ABSTRACT

An image forming apparatus including a housing, a cover, an interlock switch, a locking assembly, and a biasing assembly. The housing may comprise a pair of frames spaced apart from each other, and may form an opening between the pair of frames. The cover may move between a covered position wherein the opening is covered and an opened position wherein the opening is uncovered. The interlock switch may be pressed by the cover when the cover is in the covered position. The locking assembly may move between a locking state wherein the locking assembly locks the cover in the covered position and a released state wherein the locking assembly allows the cover to move. Further, the biasing assembly may be positioned in or on at least one of the frames, and may bias the cover toward the opened position when the cover is in the covered position.

24 Claims, 10 Drawing Sheets

IMAGE FORMING APPARATUS

CROSS-REFERENCE TO RELATED APPLICATION

This application claims priority from Japanese Patent Application No. 2014-264079 filed on Dec. 26, 2014, and Japanese Patent Application No. 2014-264082 filed on Dec. 26, 2014, which are incorporated herein by reference in their entirety.

FIELD OF DISCLOSURE

The present disclosure relates to an image forming apparatus including an openable cover provided over an opening provided in a housing.

BACKGROUND

A known image forming apparatuses including an openable cover provided over an opening provided in a housing includes a locking assembly that locks the cover that is in a closed state. When a button is pressed, the locking by the locking assembly is released. Consequently, the cover is allowed to be opened.

SUMMARY

In the above known technology, the cover is opened or closed by the user. The present disclosure provides an image forming apparatus including a cover that is easily openable by the user.

According to the above aspect of the present disclosure, when a locking assembly is released, the cover is pushed by a biasing assembly and an opening appears. Thus, the user can easily open the cover. Providing the biasing assembly in side walls of the housing, however, introduces additional challenges, such as making it easy to close the cover and avoiding damage to the cover due to bending when the cover is pushed closed from one side. One or more aspects of the present disclosure may address such additional challenges.

DETAILED DESCRIPTION

Example embodiments of the present disclosure will now be described in detail with reference to the accompanying drawings. The following description first refers to a high-level configuration (e.g., an outline configuration) of a laser printer 1 as an example of an image forming apparatus, and then to individual features of the present disclosure.

Directions to be referred to in the following description are defined with respect to the user who uses the laser printer 1. Specifically, in FIG. 1, the left side is defined as the front side, the right side is defined as the rear side, the near side is defined as the right side, and the far side is defined as the left side. Furthermore, the vertical direction in FIG. 1 is defined as the direction from bottom to top.

Figure 1:
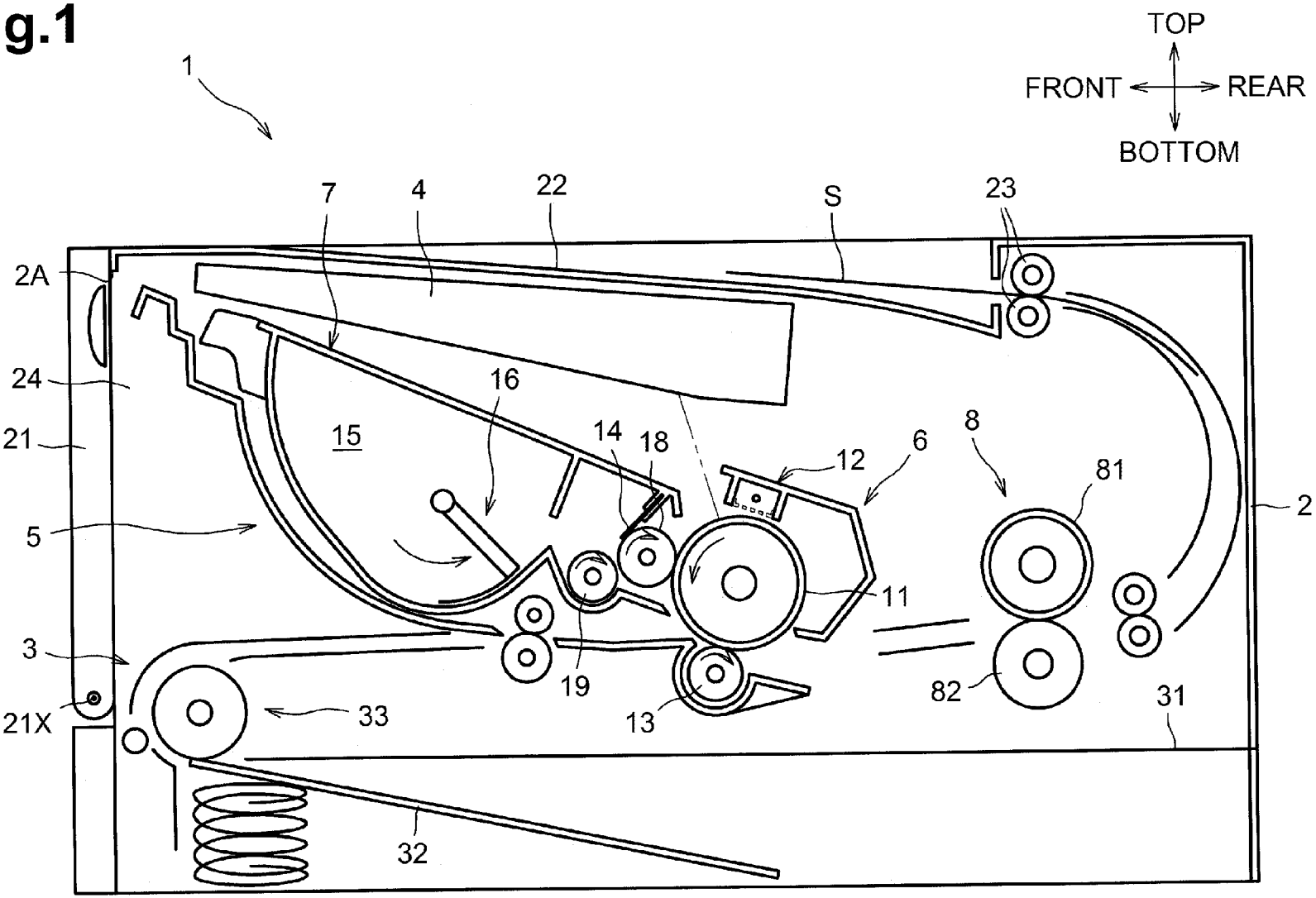
FIG. 1 illustrates a high-level configuration of a laser printer according to an embodiment of the present invention.

As illustrated in FIG. 1, the laser printer 1 includes a housing 2, a sheet feeding unit 3 that feeds a sheet S, an exposure device 4, a process cartridge 5 that transfers a toner image to the sheet S, and a fixing device 8 that thermally fixes the toner image on the sheet S.

Figure 2:
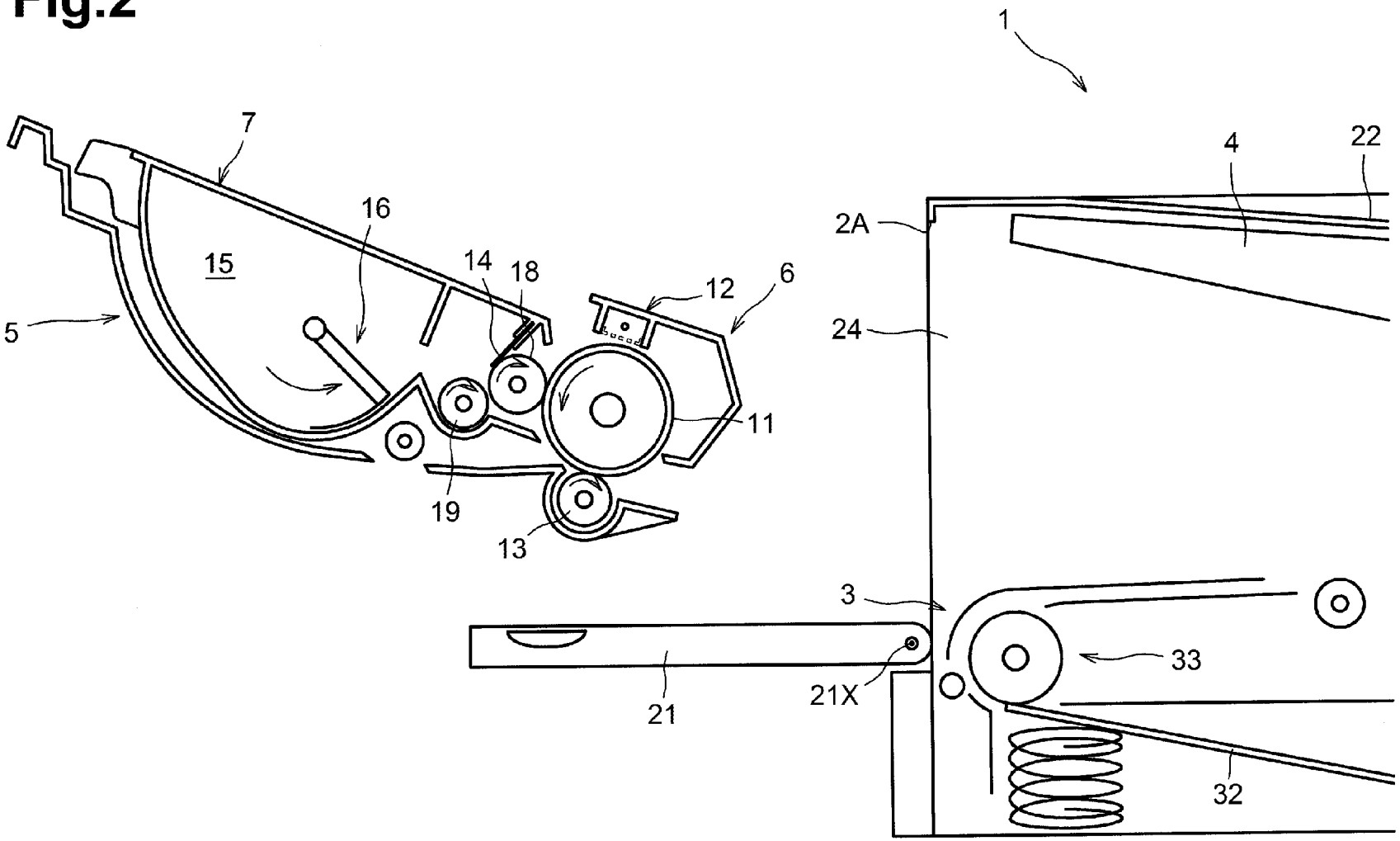
FIG. 2 illustrates an example state where a front cover has been opened and a process cartridge has been removed from a housing.

The housing 2 has a front cover 21, as an example cover, rotatably provided thereon. The front cover 21 is openable and closable and is provided over an attaching opening 2A as an example opening. The attaching opening 2A is provided in a front face, as an example of one of the side faces, of the housing 2. The lower end of the front cover 21 is rotatably supported by the housing 2 such that the front cover 21 is rotatable about a rotating axis 21X extending in a horizontal direction that is perpendicular to the vertical direction. Thus, the front cover 21 is movable between a covered position illustrated in FIG. 1 where the attaching opening 2A is covered and an opened position illustrated in FIG. 2 where the attaching opening 2A is uncovered.

Referring to FIG. 1, the sheet feeding unit 3 is provided in a lower (e.g., bottom) part of the housing 2 and includes a sheet tray 31, a sheet pressing plate 32, and a sheet feeding mechanism 33. Sheets S stacked on the sheet tray 31 may be pushed upward by the sheet pressing plate 32. In this state, the sheets S may be fed one by one toward the process cartridge 5 (toward the nip between a photoconductor drum 11 and a transfer roller 13) by the sheet feeding mechanism 33.

The exposure device 4 may be provided in an upper part of the housing 2 and includes a laser emitting portion, a polygon mirror, lenses, reflectors, and so forth (all not illustrated). The exposure device 4 may apply laser light (represented by the dash-dot-dot line in FIG. 1) to the surface of the photoconductor drum 11 while scanningly moving the laser light at a high speed. The laser light may be generated on the basis of image data and may be emitted from the laser emitting portion.

The process cartridge 5 may be provided below the exposure device 4. The process cartridge 5 may be movable between an attached position illustrated in FIG. 1 where the process cartridge 5 has been attached to the housing 2 through the attaching opening 2A that appears when the front cover 21 is rotated, and a detached position illustrated in FIG. 2 where the process cartridge 5 is on the outer side of the housing 2, in contrast to the attached position. The process cartridge 5 may include a drum cartridge 6 and a developing cartridge 7.

The drum cartridge 6 may include the photoconductor drum 11, a charger 12, and the transfer roller 13.

The developing cartridge 7 may be detachably attached to the drum cartridge 6. The process cartridge 5 (including its developing cartridge 7 and drum cartridge 6) may be detachably attached to the housing 2. The developing cartridge 7 may include a developing roller 18, a supply roller 19, a layer-thickness-regulating blade 14, a toner container 15 that may contain toner, and an agitator 16.

In the process cartridge 5, the surface of the photoconductor drum 11 may be evenly charged by the charger 12 and is then exposed to the laser light that is emitted from the exposure device 4 and is scanned thereover at a high speed, whereby an electrostatic latent image based on the image data is formed on the photoconductor drum 11. Meanwhile, the toner in the toner container 15 that is agitated by the agitator 16 is supplied to the supply roller 19 and then to the developing roller 18. As the developing roller 18 rotates, the toner passes through the gap between the developing roller 18 and the layer-thickness-regulating blade 14, whereby the developing roller 18 carries a thin layer of toner having a specific thickness.

The toner carried by the developing roller 18 may be supplied from the developing roller 18 to the electrostatic latent image on the photoconductor drum 11. Thus, the electrostatic latent image may be visualized, that is, a toner image is formed on the photoconductor drum 11. Subsequently, the sheet S may be transported through the nip between the photoconductor drum 11 and the transfer roller 13, whereby the toner image on the photoconductor drum 11 is transferred to the sheet S.

The fixing device 8 may be provided on the rear side with respect to the process cartridge 5 and may include a heat roller 81 and a pressure roller 82 that is pressed against the heat roller 81. In the fixing device 8, the toner image transferred to the sheet S may be thermally fixed while the sheet S is passing through the nip between the heat roller 81 and the pressure roller 82. The sheet S to which the toner image has been thermally fixed may be discharged onto a discharge tray 22 by a pair of discharge rollers 23.

Figure 3:
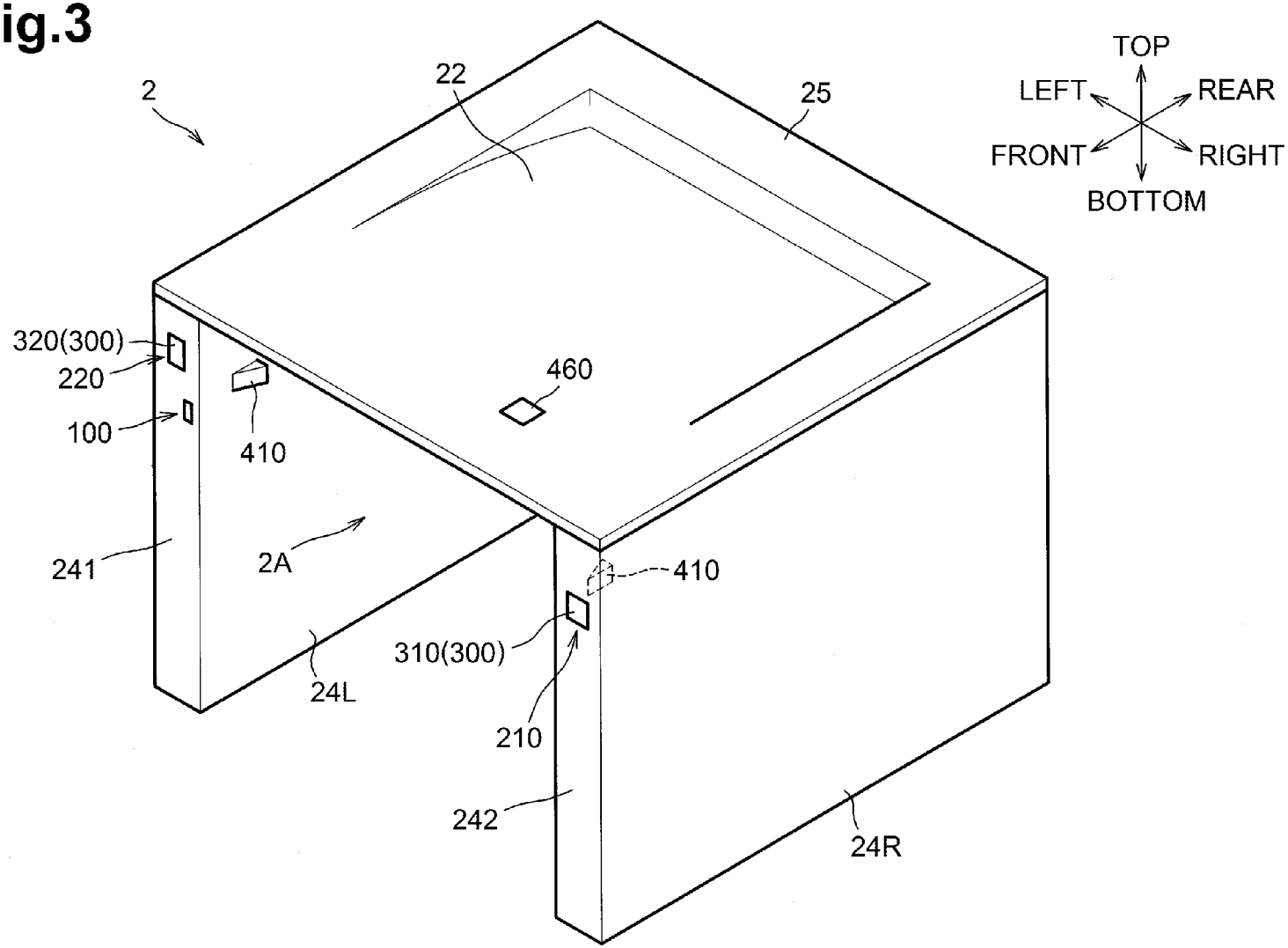
FIG. 3 is an example perspective view of a pair of frames and a top cover.

As illustrated in FIG. 3, the housing 2 includes a pair of frames 24R and 24L that are spaced apart from each other in the horizontal direction, and a top cover 25 that covers the upper side of the pair of frames 24R and 24L.

The top cover 25 bridges the pair of frames 24R and 24L and provides the discharge tray 22 on the top face thereof. The pair of frames 24R and 24L are provided on the right and left sides, respectively, of the process cartridge 5 and support the process cartridge 5, the fixing device 8, and other associated elements. The attaching opening 2A provided in the front face of the housing 2 is positioned between the pair of frames 24R and 24L. In FIG. 3, the front cover is removed to depict the attaching opening 2A.

The left frame 24L has a switch opening 100 provided in a front wall 241 thereof. The pair of frames 24R and 24L have respective biasing assemblies 300 that press the front cover 21 at the covered position toward the opened position, i.e., in a direction away from the front face of the housing 2. Specifically, the biasing assemblies 300 include a first biasing assembly 310 supported by a first supporting portion 210 provided in the right frame 24R, and a second biasing assembly 320 supported by a second supporting portion 220 provided in the left frame 24L.

Figure 4A:
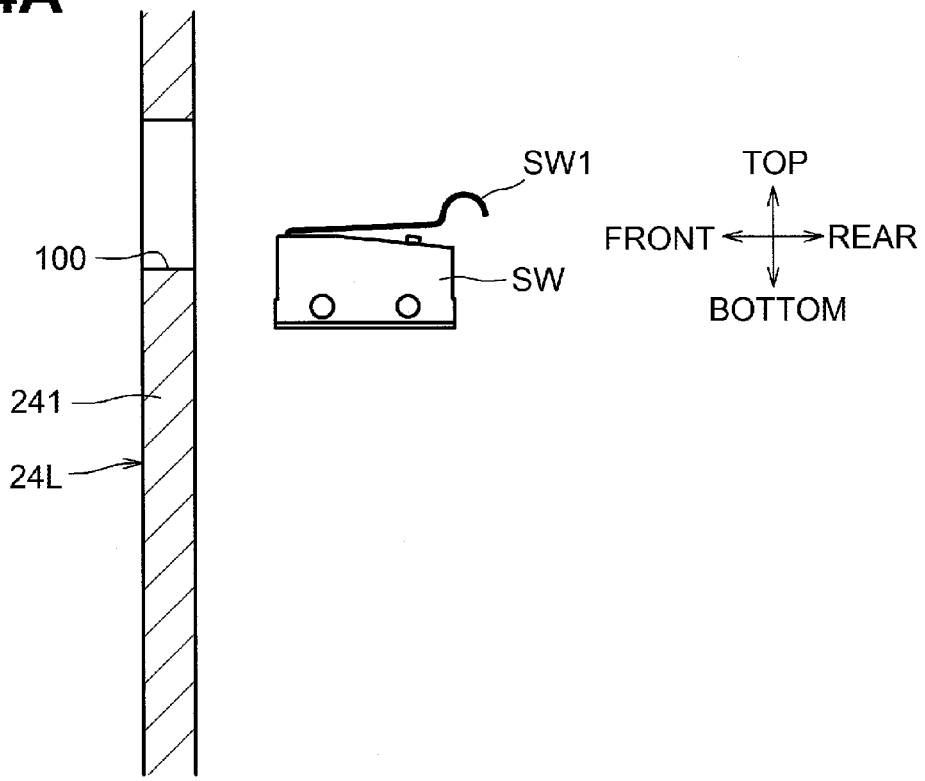
FIG. 4A illustrates an example interlock switch and example peripheral elements in an example state where the front cover is at an opened position.

As illustrated in FIG. 4A, an interlock switch SW that detects the opening and closing of the front cover 21 is provided behind the switch opening 100 (e.g., in a rear direction from the switch opening 100).

Figure 4B:
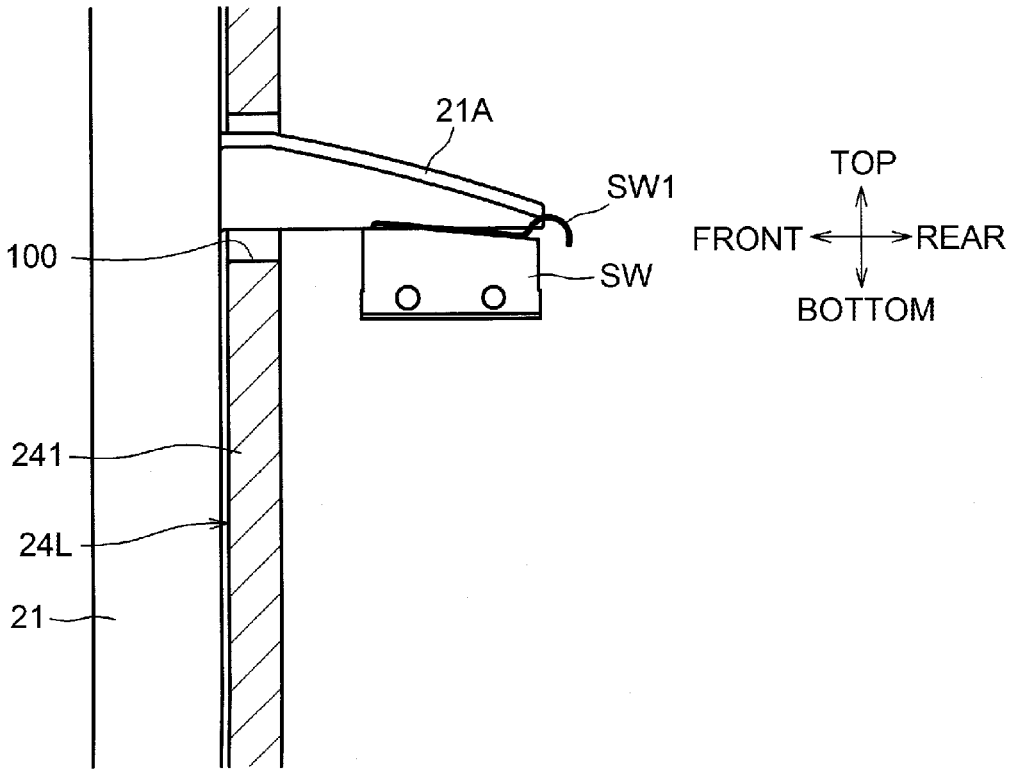
FIG. 4B illustrates the interlock switch and peripheral elements in an example state where the front cover is at a covered position.

The interlock switch SW is supported by the left frame 24L. The interlock switch SW includes a lever SW1. The front cover 21 includes a switch-pressing projection 21A. When the front cover 21 is at the covered position as illustrated in FIG. 4B, the switch-pressing projection 21A is fitted in the switch opening 100 and presses the lever SW1 of the interlock switch SW.

When the lever SW1 is pressed, the interlock switch SW detects (e.g., based on metal contact between the lever SW1 and interlock switch SW) that the front cover 21 has been moved to the covered position. When the lever SW1 that has been pressed is released, the interlock switch SW detects that the front cover 21 has been moved to the opened position. The lever SW1 is, for example, a leaf spring. When the front cover 21 is at the covered position, the lever SW1 biases the switch-pressing projection 21A toward the upper front.

Figure 5A:
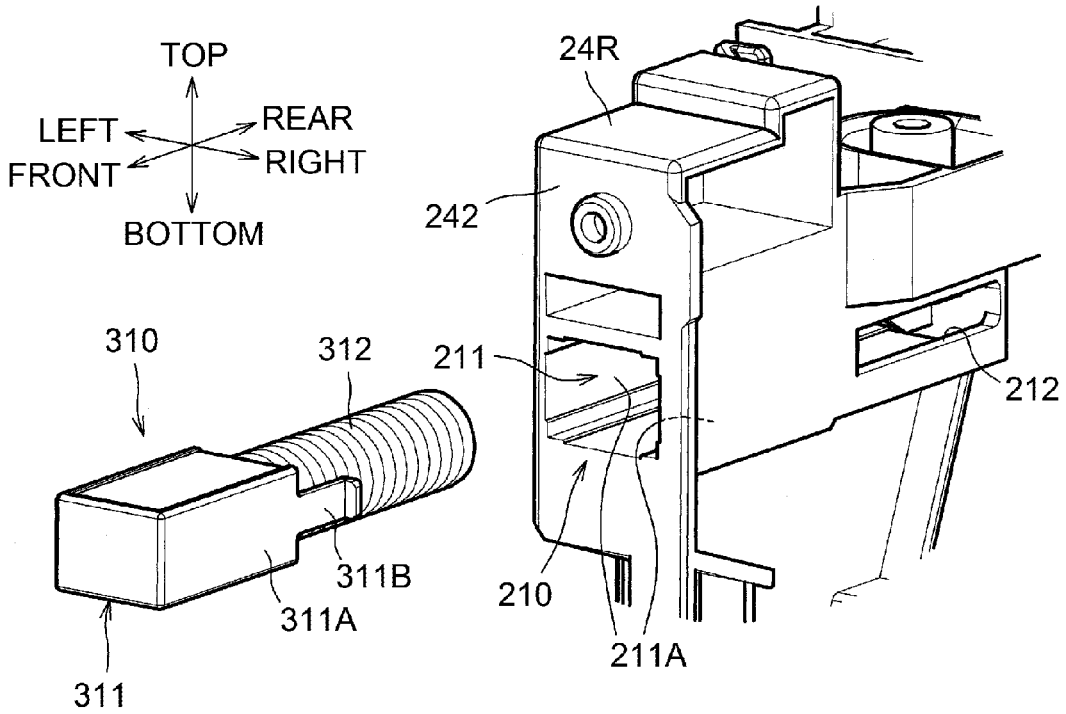
FIG. 5A is an example exploded perspective view of a first biasing assembly and a first supporting portion.
Figure 5B:
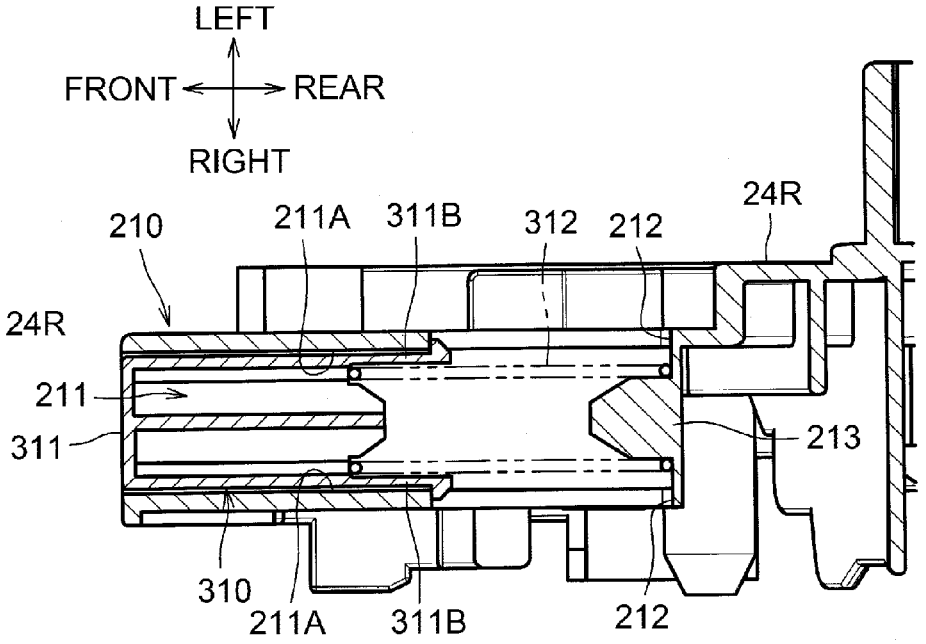
FIG. 5B is an example horizontal sectional view of the first biasing assembly and the first supporting portion.

As illustrated in FIGS. 5A and 5B, the first supporting portion 210 includes a recess 211 provided in an upper part of a front wall 242 of the right frame 24R; and slots 212, as exemplary grooves, provided in the right and left walls 211A, respectively, of the recess 211.

The recess 211 is open on the front side thereof, on which the front cover 21 is provided. The recess 211 extends from the front end of the right frame 24R toward the rear side.

The slots 212 each extend in the anteroposterior direction that is orthogonal to the horizontal direction corresponding to a direction in which the pair of frames 24R and 24L face each other. While the slot 212 according to the present embodiment is a hole horizontally extending through a corresponding one of the wall 211A, the groove may be a depression provided in the inner surface of the wall 211A.

The first biasing assembly 310 is provided separately from the interlock switch SW and presses the front cover 21 that is at the covered position toward the front side. The first biasing assembly 310 includes a first sliding member 311 that is positioned in the recess 211, and a first spring 312 that biases the first sliding member 311 toward the front side.

The first sliding member 311 includes a box-shaped first body 311A and first engaging portions 311B. The first engaging portions 311B are exemplary engaging portions and each have a hook-like shape extending from a corresponding one of right and left sidewalls of the first body 311A toward the rear side. The first sliding member 311 is slidable in the anteroposterior direction in the recess 211, with the first engaging portions 311B moving along the respective slots 212 of the first supporting portion 210.

The first spring 312 is, for example, a compression coil spring and is positioned between the first body 311A of the first sliding member 311 and a bottom wall 213 of the recess 211.

Figure 6A:
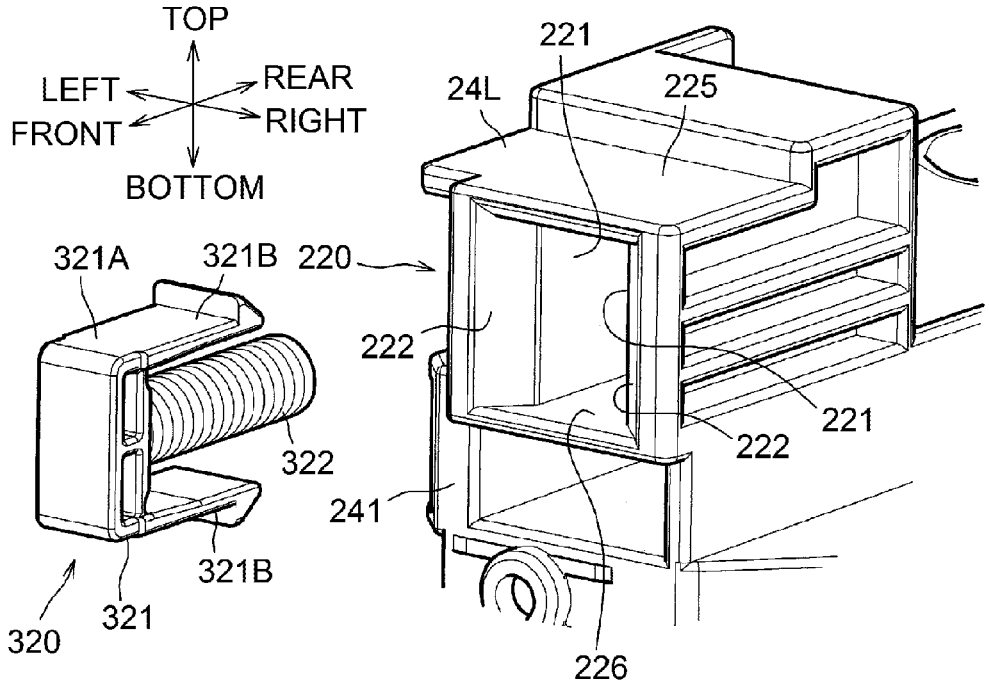
FIG. 6A is an example exploded perspective view of a second biasing assembly and a second supporting portion.
Figure 6B:
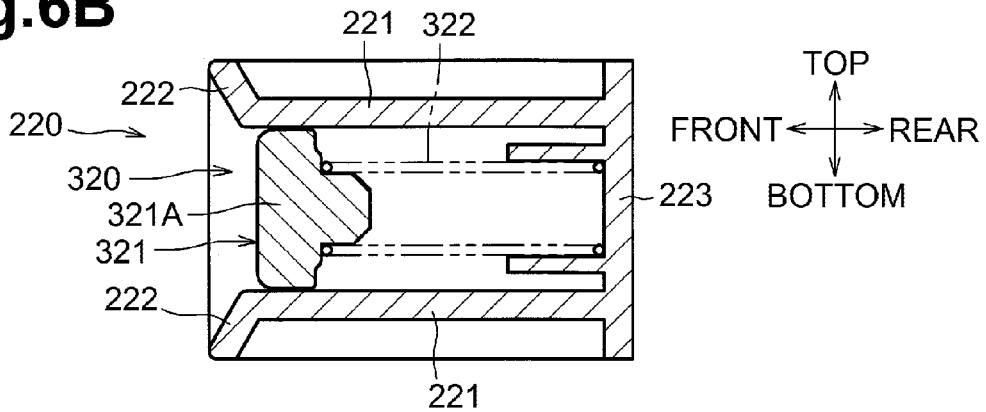
FIG. 6B is an example horizontal sectional view of the second biasing assembly and the second supporting portion.
Figure 6C:
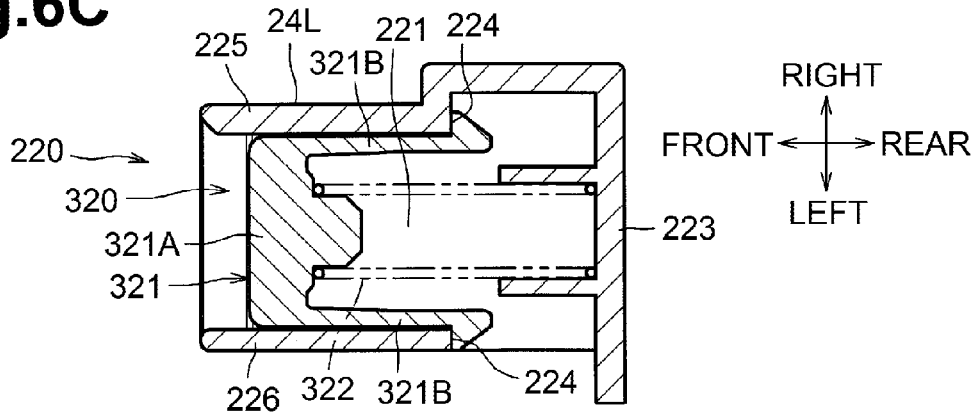
FIG. 6C is an example vertical sectional view of the second biasing assembly and the second supporting portion.

As illustrated in FIGS. 6A to 6C, the second supporting portion 220 is provided in an upper part of the front wall 241 of the left frame 24L. The second supporting portion 220 includes a pair of opposite walls 221 provided opposite each other in the horizontal direction, a pair of guide walls 222 provided on the front side with respect to the pair of opposite walls 221, respectively, a rear wall 223 connecting the respective rear ends of the pair of opposite walls 221, an upper wall 225 connecting the respective upper ends of the pair of opposite walls 221, and a lower wall 226 connecting the respective lower ends of the pair of opposite walls 221.

The pair of guide walls 222 each extend from a corresponding one of the pair of opposite walls 221 to the front end of the left frame 24L while inclining horizontally outward toward the front end of the left frame 24L.

The upper wall 225 and the lower wall 226 are spaced apart from the rear wall 223 and each have a catching surface 224 at the rear end thereof. The catching surface 224 extends horizontally.

The second biasing assembly 320 is provided separately from the interlock switch SW and presses the front cover 21 that is at the covered position toward the front side. The second biasing assembly 320 includes a second sliding member 321 that is positioned between the pair of opposite walls 221, and a second spring 322 that biases the second sliding member 321 toward the front side.

The second sliding member 321 includes a second body 321A and second engaging portions 321B. The size of the second body 321A in the horizontal direction is substantially equal to the gap between the pair of opposite walls 221. The second engaging portions 321B each have a hook-like shape and extend toward the rear side from a corresponding one of the upper and lower ends of the second body 321A. The second sliding member 321 is slidable in the anteroposterior direction along the pair of opposite walls 221. Since the second engaging portions 321B is configured to engage with the respective catching surfaces 224 of the second supporting portion 220, the second sliding member 321 is prevented from coming out of the second supporting portion 220.

The second spring 322 is, for example, a compression coil spring and is positioned between the second body 321A of the second sliding member 321 and the rear wall 223 of the second supporting portion 220.

Figure 7:
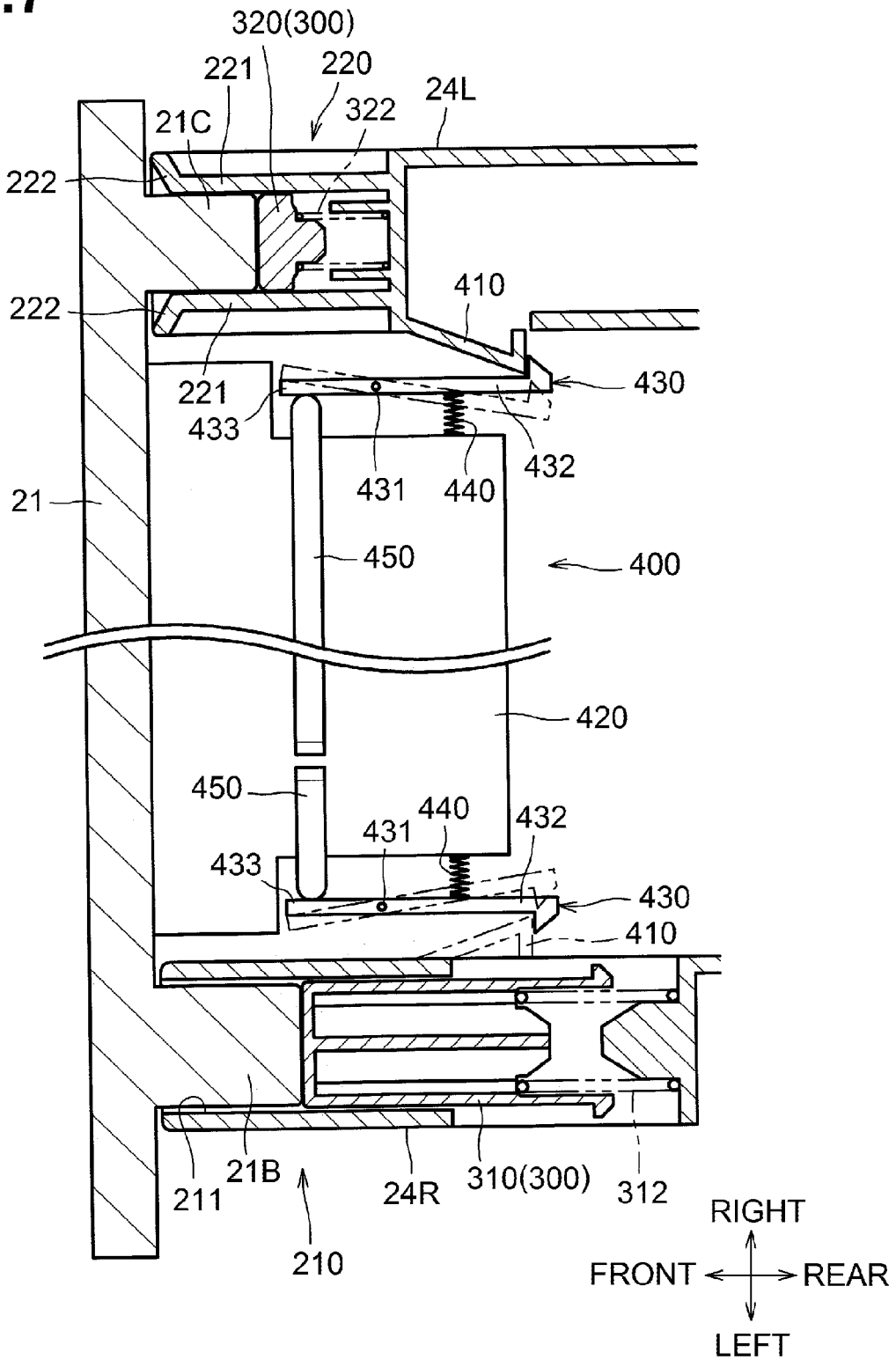
FIG. 7 is an example horizontal sectional view of the pair of frames and the front cover, illustrating configurations of the first biasing assembly, the second biasing assembly, and a locking assembly.

As illustrated in FIG. 7, the front cover 21 includes a first projection 21B provided at a position thereof corresponding to the first biasing assembly 310. When the front cover 21 is at the covered position, the first projection 21B is pressed toward the front side by the first biasing assembly 310. The front cover 21 also includes a second projection 21C, as an exemplary projection, provided at a position thereof corresponding to the second biasing assembly 320. When the front cover 21 is at the covered position, the second projection 21C is pressed toward the front side by the second biasing assembly 320.

The first projection 21B is a projection that is fitted in the recess 211 of the first supporting portion 210 when the front cover 21 is at the covered position. The vertical size and the horizontal size of the first projection 21B are slightly smaller than the vertical size and the horizontal size of the recess 211.

The second projection 21C is a projection that is fitted in the gap between the pair of opposite walls 221 of the second supporting portion 220 when the front cover 21 is at the covered position. The horizontal size of the second projection 21C is substantially equal to the size of the gap between the pair of opposite walls 221. Hence, when the front cover 21 is at the covered position, the second projection 21C is in engagement with the pair of opposite walls 221, whereby the horizontal position of the front cover 21 with respect to the housing 2 is determined. That is, the second supporting portion 220 functions as a positioning portion that receives the second projection 21C and determines the position, with respect to the housing 2, of the front cover 21 that is at the covered position. Since the second supporting portion 220 also functions as a positioning portion as described above, the configuration of the housing 2 becomes simpler with a smaller number of components than in a case where a positioning portion is provided separately from the second supporting portion 220.

Figure 8:
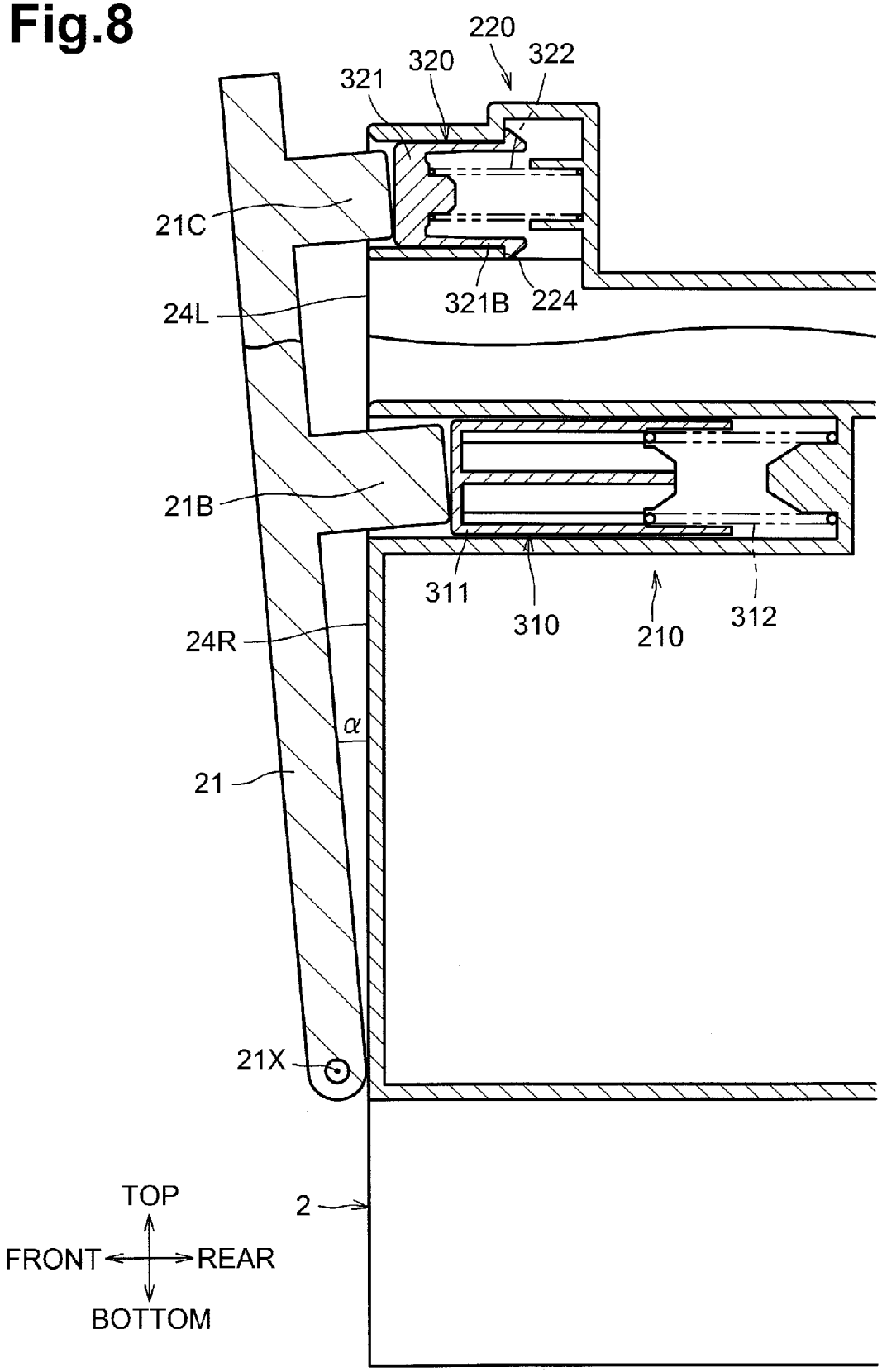
FIG. 8 is an example vertical sectional view of the first biasing assembly, the second biasing assembly, and the front cover in a state where the second biasing assembly has pushed the front cover toward the front side to the maximum.

As illustrated in FIG. 8, the second supporting portion 220 functioning as a positioning portion is provided at a position higher than the first supporting portion 210, that is, at a position farther from the rotating axis 21X of the front cover 21 than the first supporting portion 210. By providing the second supporting portion 220 at a higher position than the first supporting portion 210, the front cover 21 may be better oriented with respect to the housing 2 so that a user may more easily close the front cover 21 properly. By providing the second supporting portion 220 at a higher position than the first supporting portion 210, the second supporting portion 220 may be better suited to receive the second projection 21C.

Furthermore, since the first supporting portion 210 and the second supporting portion 220 are provided at different heights, the first biasing assembly 310 and the second biasing assembly 320 are positioned at different heights. Specifically, the first supporting portion 210 and the first biasing assembly 310 is positioned lower than the second supporting portion 220 and the second biasing assembly 320, that is, closer to the rotating axis 21X of the front cover 21 than the second supporting portion 220 and the second biasing assembly 320. In the present embodiment, the first biasing assembly 310 and the second biasing assembly 320 are positioned farther from the rotating axis 21X of the front cover 21 than the interlock switch SW.

The first spring 312 and the second spring 322, for example, have different spring moduli and different initial amounts of contraction, so that the first biasing assembly 310 and the second biasing assembly 320 press the front cover 21 at the covered position with the same torque. That is, the frontward moment about the rotating axis 21X that is generated by the pressing force of the first biasing assembly 310 and acts on the front cover 21 may be equal to the frontward moment about the rotating axis 21X that is generated by the pressing force of the second biasing assembly 320 and acts on the front cover 21.

The angle by which the front cover 21 moves from the covered position toward the opened position by being pushed by the first biasing assembly 310 may be larger than the angle by which the front cover 21 moves from the covered position toward the opened position by being pushed by the second biasing assembly 320.

Figure 9:
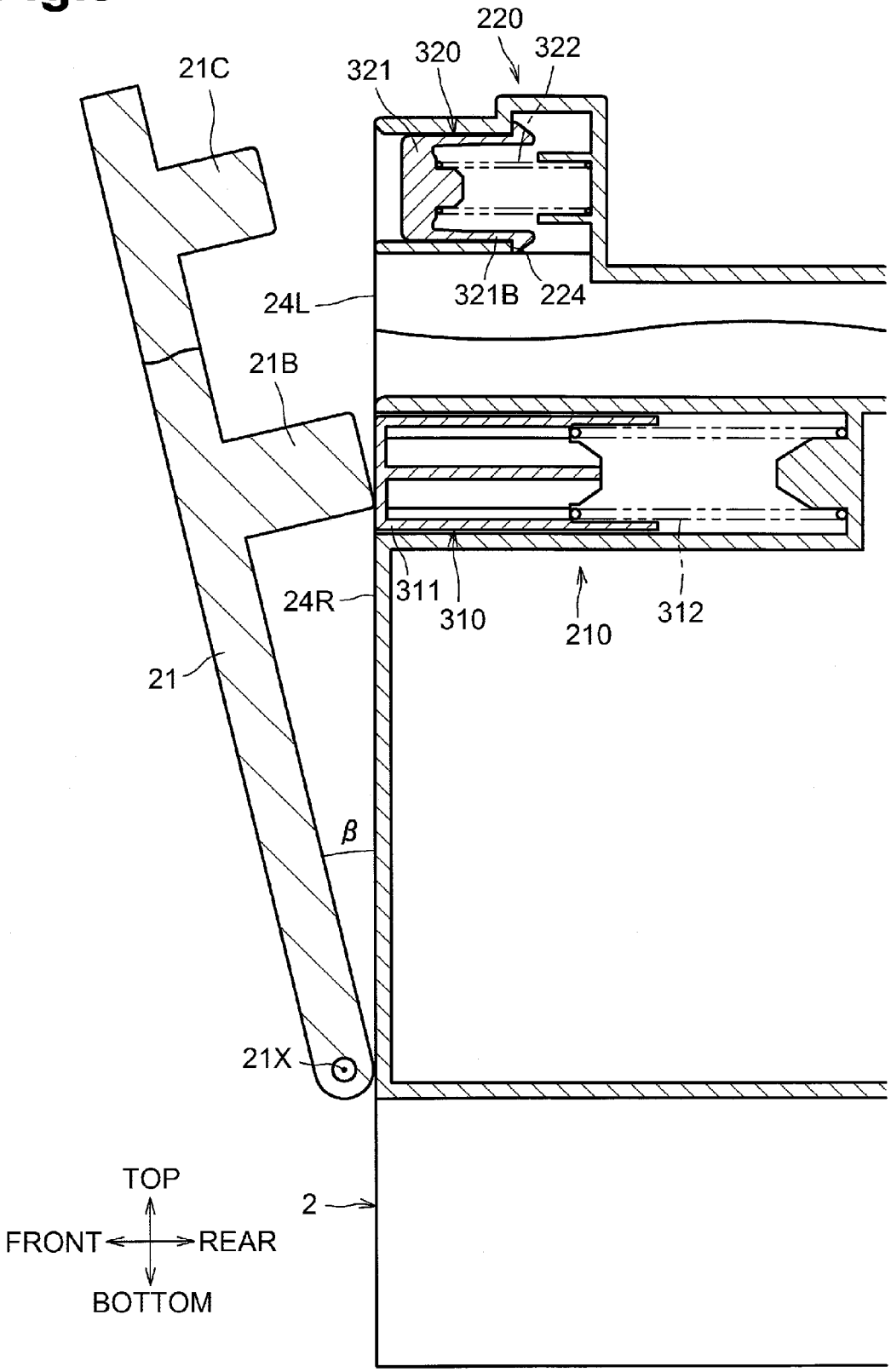
FIG. 9 is an example vertical sectional view of the first biasing assembly, the second biasing assembly, and the front cover in a state where the first biasing assembly has pushed the front cover toward the front side to the maximum.

Specifically, the length by which the first biasing assembly 310 is slidable in the anteroposterior direction may be longer than the length by which the second biasing assembly 320 is slidable in the anteroposterior direction. These lengths may be different to accommodate different lengths of the first projection 21B and second projection 21C. In some cases, the first projection 21B may be longer than the second projection 21C. Therefore, as illustrated in FIGS. 8 and 9, an angle 13 by which the front cover 21 rotates from the covered position when the first biasing assembly 310 has pushed the first projection 21B toward the front side to the maximum may be larger than an angle $\alpha$ by which the front cover 21 rotates from the covered position when the second biasing assembly 320 has pushed the second projection 21C toward the front side to the maximum. Hence, while the first biasing assembly 310 is pushing the first projection 21B toward the front side as illustrated in FIG. 8, the second projection 21C may move out of contact with the second biasing assembly 320. Here, the angle by which the front cover 21 rotates from the covered position refers to an angle of rotation of the front cover 21 with respect to the front walls 241 and 242 of the pair of frames 24R and 24L.

The first projection and the second projection may have the same length. In that case also, the front cover 21 is rotated by a larger angle by the first pressing member provided at the lower position (closer to the rotating axis 21X of the front cover 21) than the second pressing member.

As illustrated in FIG. 7, the laser printer 1 may include a locking assembly 400 that locks the front cover 21 in the covered position.

The locking assembly 400 may include first locking members 430 provided on the front cover 21, second locking members 410 provided on the pair of frames 24R and 24L, respectively, and activating portions 450. As illustrated in FIG. 3, the top cover 25 has a button 460 (see FIG. 10). The button 460 is movable between a regular position (illustrated by solid line) and an operated position (illustrated by dash-dot-dot lines) that is pressed down from the regular position. The button 460 may act on (or affect) the locking assembly 400.

The second locking members 410 project from the horizontally inner surfaces of the respective frames 24R and 24L toward the horizontally inner side. The second locking members 410 are each provided on the horizontally inner side with respect to a corresponding one of the biasing assemblies 300.

As illustrated in FIG. 7, the first locking members 430 are provided at positions that face the respective second locking members 410. The first locking members 430 are rotatably supported by a locking assembly-supporting portion 420 that projects from a position of the inner surface of the front cover 21 between the first projection 21B and the second projection 21C.

When the front cover 21 is at the covered position, the locking assembly-supporting portion 420 may be positioned between the pair of frames 24R and 24L. The first locking members 430 may each include a shaft 431 supported by the locking assembly-supporting portion 420, a hook portion 432 extending from the shaft 431 toward the rear side, and an activated portion 433 extending from the shaft 431 toward the front side. The state of the first locking members 430 may change between a locking state (illustrated by solid lines) and a released state (illustrated by dash-dot-dot lines). In the locking state, the hook portion 432 of each first locking member 430 that has been rotated about the shaft 431 is in engagement with a corresponding one of the second locking members 410, whereby the front cover 21 at the covered position is locked. In the released state, the hook portion 432 has been disengaged from the second locking member 410, whereby the front cover 21 is allowed to move.

The hook portion 432 of the first locking member 430 may be biased by a compression coil spring 440, which is provided between the hook portion 432 and the locking assembly-supporting portion 420, toward a corresponding one of the second locking members 410 provided on the frames 24R and 24L so as to engage therewith. Hence, when the front cover 21 is at the covered position, the first locking member 430 may be in the locking state.

Figure 10:
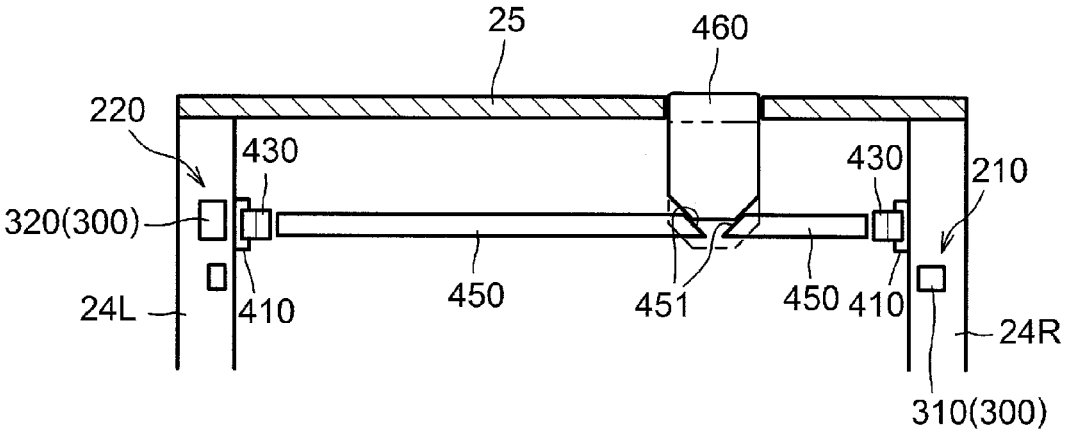
FIG. 10 is an example sectional view of the locking assembly and a lock-disabling button.

When the button 460 is operated and situated in the operated position, the activating portions 450 activate the respective first locking members 430. The activating portions 450 may each be a stick-like member extending from the horizontally inner side of the activated portion 433 of a corresponding one of the first locking members 430 toward the horizontally inner side of the activated portion 433 of the other first locking member 430. The activating portions 450 may be supported by the locking assembly-supporting portion 420 in such a manner as to be slidable in the horizontal direction. As illustrated in FIG. 10, the two activating portions 450 may be provided side by side in the horizontal direction with a small gap interposed therebetween. The horizontally inner-side end of each of the activating portions 450 may be located on the left side with respect to the horizontal center of the front cover 21. The activating portions 450 may each have an inclined surface 451 at the horizontally inner-side end thereof. The inclined surface 451 inclines downward toward the end of the activating portion 450.

The button 460 may affect the locking assembly 400 when operated, and change the state of the locking assembly 400 from the locking state to the released state. The button 460 may be supported by the top cover 25 in such a manner as to be vertically movable. The button 460 may be positioned on the inclined surfaces 451 of the two activating portions 450 and may have a tapered lower end. When the button 460 is moved downward, the button 460 slides along the inclined surfaces 451 and may push the two activating portions 450 horizontally outward away from the image forming apparatus.

The button 460 may be provided at a position, in the horizontal direction, closer to the first biasing assembly 310 and the first supporting portion 210 than to the second biasing assembly 320 and the second supporting portion 220.

Operations of the laser printer 1 configured as described above and advantageous effects produced by the laser printer 1 will now be described.

To open the front cover 21, the user may press down the button 460 from the regular position to the operated position. When the button 460 is pressed down, the activating portions 450 may push the activated portions 433 of the respective first locking members 430 horizontally outward. Consequently, the first locking members 430 are rotated, and the state thereof is changed from the locking state to the released state.

Thus, the locking of the front cover 21 to the housing 2 may be released. Accordingly, the front cover 21 may be pushed toward the front side by the biasing assemblies 300 as illustrated in FIG. 8 and rotates from the covered position toward the opened position. In the present embodiment, when the locking assembly 400 is released, the front cover 21 is opened and the attaching opening 2A appears. Thus, the user can easily open the front cover 21.

Furthermore, the biasing assemblies 300 may include the first biasing assembly 310 provided in the right frame 24R, and the second biasing assembly 320 provided in the left frame 24L. That is, the front cover 21 may be pressed at two positions that are horizontally spaced apart from each other. Therefore, the front cover 21 is prevented from being obliquely oriented when closed, reducing the probability that only one side of the front cover 21 may be closed, compared with a case where the front cover 21 is pressed by one pressing member.

Furthermore, although the first biasing assembly 310 and the second biasing assembly 320 according to the present embodiment are provided at different heights, the first biasing assembly 310 and the second biasing assembly 320 press the front cover 21 at the covered position with the same torque. Therefore, the front cover 21 is prevented from being obliquely oriented when closed, reducing the probability that only one side of the front cover 21 may be closed.

Furthermore, according to the present embodiment, the first biasing assembly 310 is positioned closer to the rotating axis 21X of the front cover 21 than the second biasing assembly 320, and the first biasing assembly 310 moves the front cover 21 from the covered position by a larger angle than the second biasing assembly 320 does. Therefore, if the user opens or closes the front cover 21 while holding a portion of the front cover 21 that is on the left side with respect to the center, a portion of the front cover 21 that is on the right side with respect to the center and is not held by the user may be pushed significantly by the first biasing assembly 310, making the front cover 21 oriented obliquely, resulting in a situation where only one side of the front cover 21 may be closed. However, in the laser printer 1, since the button 460 is provided nearer to the right frame 24R than to the left frame 24L, it is expected that the user who has operated the button 460 will hold a position of the front cover 21 that is on the right side with respect to the center with his/her hand that is used in operating the button 460. That is, the user tends to hold a side of the front cover 21 that is significantly pushed by the first biasing assembly 310. Therefore, the front cover 21 is prevented from being obliquely oriented, reducing the probability that only one side of the front cover 21 may be closed.

While an embodiment of the present disclosure has been described above, the present disclosure is not limited to the above embodiment. Specific configurations of the elements described above are appropriately changeable without departing from the scope of the present disclosure.

While the biasing assemblies 300 (the first biasing assembly 310 and the second biasing assembly 320) according to the above embodiment are configured to press the front cover 21 at the covered position toward the front side, the pressing members are not limited to have such a configuration. For example, the pressing members may be configured to press the front cover 21 toward the upper front side or toward the lower front side.

While the first biasing assembly 310 and the second biasing assembly 320 according to the above embodiment are provided at different heights, the first pressing member and the second pressing member may be provided at the same height.

While the button 460 according to the above embodiment is provided on the top cover 25, the lock-disabling button is not limited to be provided at such a position. For example, the lock-disabling button may be provided on the front cover 21.

What is claimed is:

1. An image forming apparatus comprising:

a housing comprising a first frame and a second frame spaced apart from each other, the housing forming an opening between the first frame and the second frame;

a cover configured to move between a covered position wherein the opening is covered and an opened position wherein the opening is uncovered;

an interlock switch that is pressed by the cover when the cover is in the covered position;

a locking assembly different from the interlock switch, the locking assembly configured to move between a locking state wherein the locking assembly locks the cover in the covered position and a released state wherein the locking assembly allows the cover to move, wherein, when the locking assembly is in the locking state, the locking assembly including a locking assembly portion of the housing configured to engage with a first portion of the cover;

a first biasing assembly provided separately from the interlock switch and separately from the locking assembly, the first biasing assembly positioned in or on the first frame, the first biasing assembly biasing the cover toward the opened position when the cover is in the covered position, the first biasing assembly comprising a first contact portion disposed in the housing and configured to contact a second portion of the cover, different from the first portion; and a second biasing assembly provided separately from the interlock switch and separately from the locking assembly, the second biasing assembly positioned in or on the second frame, the second biasing assembly biasing the cover toward the opened position when the cover is in the covered position, the second biasing assembly comprising a second contact portion disposed in the housing and configured to contact a third portion of the cover, different from the first and second portions, wherein the first portion of the cover, the second portion of the cover and the locking assembly portion of the housing are different from one another.

2. The image forming apparatus according to claim 1, wherein the first biasing assembly and the second biasing assembly are configured to bias the cover in the covered position with respective torques that are approximately equal to each other.

3. The image forming apparatus according to claim 2, wherein the locking assembly comprises:

a pair of first locking members extending from the cover as the first portion of the cover; and a pair of second locking members respectively extending from the first frame and the second frame as the locking assembly portion of the housing, the second locking members respectively engaged with the first locking members when the cover is at the covered position.

4. The image forming apparatus according to claim 1, wherein the locking assembly comprises:

a first locking member extending from the cover as the first portion of the cover; and a second locking member extending from at least one of the first frame or the second frame as the lock assembly portion of the housing, the second locking member engaged with the first locking member when the cover is at the covered position.

5. The image forming apparatus according to claim 4, wherein the second locking member extends from an inner side with respect to the second biasing assembly in a direction in which the first frame and the second frame face each other.

6. The image forming apparatus according to claim 1, wherein the cover comprises a rotating axis rotatably supporting the cover, the rotating axis extending in a direction in which the first frame and the second frame face each other, wherein the rotating axis is closer to the first biasing assembly than the second biasing assembly in a vertical direction.

7. The image forming apparatus according to claim 6, wherein an angle by which the cover moves from the covered position toward the opened position as a result of bias by the first biasing assembly is greater than an angle by which the cover moves from the covered position toward the opened position as a result of bias by the second biasing assembly.

8. The image forming apparatus according to claim 7, further comprising:

a button configured to move between a regular position and an operated position in which the button contacts the locking assembly and configured to change the locking assembly from the locking state to the released state, wherein the button is disposed on the housing, closer to the first biasing assembly than the second biasing assembly in the direction in which the first frame and the second frame face each other.

9. The image forming apparatus according to claim 1, wherein the first frame comprises:

a first supporting portion supporting the first biasing assembly;

wherein the second frame comprises:

a second supporting portion supporting the second biasing assembly, the second supporting portion including:

a pair of opposite walls provided opposite each other in a direction in which the first frame and the second frame face each other; and a pair of guide walls each extending from a corresponding one of the pair of opposite walls to an end of the second frame that is nearest to the cover, wherein the guide walls extend away from each other, in the direction in which the first frame and the second frame face each other, as the guide walls extend toward the end of the second frame; and wherein the third portion of the cover includes a projection that is positioned between the pair of opposite walls and contacts the second biasing assembly when the cover is situated in the covered position.

10. The image forming apparatus according to claim 9, further comprising:

a button configured to move between a regular position and an operated position in which the button contacts the locking assembly and configured to change the locking assembly from the locking state to the released state, and wherein the button is disposed on the housing, closer to the first supporting portion than the second supporting portion in the direction in which the first frame and the second frame face each other.

11. The image forming apparatus according to claim 9, wherein the cover comprises a rotating axis rotatably supporting the cover, the rotating axis extending in the direction in which the first frame and the second frame face each other, wherein the rotating axis is closer to the first supporting portion than the second supporting portion.

12. The image forming apparatus according to claim 9, wherein the first supporting portion has a recess opened toward the cover situated in the covered position, and a groove provided in a wall of the recess and extending in a direction orthogonal to the direction in which the first frame and the second frame face each other, wherein the first biasing assembly includes:

a first sliding member provided in the recess as the first contact portion, and a first spring biasing the first sliding member toward the cover, and wherein the first sliding member includes a clasp that engages the groove and is configured to slide in the recess along the groove.

13. The image forming apparatus according to claim 9, wherein the second biasing assembly includes:

a second sliding member positioned between the pair of opposite walls as the second contact portion, the second sliding member configured to slide in a direction orthogonal to a direction in which the pair of opposite walls face each other; and a second spring biasing the second sliding member toward the cover.

14. The image forming apparatus according to claim 1, wherein the cover comprises a rotating axis rotatably supporting the cover, the rotating axis extending in a direction in which the first frame and the second frame face each other, and wherein the first biasing assembly is farther from the rotating axis than the interlock switch.

15. An image forming apparatus comprising:

a first side wall;

a second side wall spaced apart from the first side wall; and a cover configured to move between an open position and a closed position, wherein the cover, the first side wall, and the second side wall form an opening when the cover is in the open position, wherein the first side wall comprises:

an interlock switch that is pressed by the cover when the cover is in the closed position; and a first biasing assembly different from the interlock switch and that biases the cover toward the open position when the cover is in the closed position, and wherein the second side wall comprises:

a second biasing assembly different from the interlock switch and that biases the cover toward the open position when the cover is in the closed position.

16. The image forming apparatus of claim 15 wherein the cover, the first side wall, and the second side wall form the opening with a size that allows a cartridge to be removed from the image forming apparatus.

17. An image forming apparatus comprising:

a first frame comprising a first interlock switch, a first groove, and a first biasing assembly different from the first interlock switch;

a second frame spaced apart from the first frame and comprising a second groove and a second biasing assembly different from the first interlock switch; and a cover comprising a first projection and an axis of rotation that extends in a first direction between the first frame and the second frame; and wherein the first biasing assembly comprises:

a first spring; and a first body comprising a first clasp, wherein the second biasing assembly comprises:

a second spring; and a second body comprising a second clasp, and wherein, when the cover is in a closed state relative to the first and second frames, the first body contacts the first projection without movably restricting the first projection, the first spring is compressed and in contact with the first body, the first clasp is engaged with the first groove, the second spring is compressed and in contact with the second body, the second clasp is engaged with the second groove, and a lever of the first interlock switch is pressed by a part of the cover.

18. The image forming apparatus of claim 17, wherein the cover faces the first frame and the second frame in a second direction that is perpendicular to the first direction;

wherein the first projection extends in the second direction; and wherein the first groove extends in the second direction.

19. The image forming apparatus of claim 18, wherein the second groove extends in the second direction;

wherein the cover further comprises a second projection extending in the second direction; and wherein, when the cover is in a closed state relative to the first and second frames, the second body contacts the second projection without movably restricting the second projection.

20. The image forming apparatus of claim 19, wherein the axis of rotation is closer to the first biasing assembly than the second biasing assembly.

21. The image forming apparatus of claim 20, wherein the second frame further comprises:

a pair of opposite walls facing each other in the first direction;

a pair of guide walls each extending from a corresponding one of the pair of opposite walls to an end of the second frame that is nearest to the cover, wherein the guide walls extend away from each other, in the first direction, as the guide walls extend toward the end of the second frame; and wherein the second projection and the second body are disposed between the pair of opposite walls.

22. The image forming apparatus of claim 19, further comprising:

a protrusion extending from the first frame, wherein the cover further comprises a hook engaged with the protrusion.

23. The image forming apparatus of claim 22, further comprising:

a button on a top surface of the image forming apparatus, the button having a wedge portion; and a bar comprising an inclined surface that complements the wedge portion, the bar extending in the first direction and having an end aligned, in the first direction, with a portion of the hook.

24. The image forming apparatus of claim 17, wherein the first frame further comprises:

a pair of opposite walls facing each other in the first direction, wherein at least one of the opposite walls comprises the first groove;

wherein the first projection and the first body are disposed between the pair of opposite walls.

* * * * *